US007258244B2

(12) United States Patent
Ungrady

(10) Patent No.: US 7,258,244 B2
(45) Date of Patent: Aug. 21, 2007

(54) HOT-FILL PLASTIC CONTAINER AND METHOD OF MANUFACTURE

(75) Inventor: Eric B. Ungrady, Maumee, OH (US)

(73) Assignee: Graham Packaging Company L.P., York, PA (US)

( * ) Notice: Subject to any disclaimer, the term of this patent is extended or adjusted under 35 U.S.C. 154(b) by 0 days.

(21) Appl. No.: 10/958,460

(22) Filed: Oct. 4, 2004

(65) Prior Publication Data

US 2006/0070976 A1 Apr. 6, 2006

(51) Int. Cl.
*B65D 1/02* (2006.01)
*B65D 1/42* (2006.01)

(52) U.S. Cl. ..... 215/381; 215/382; 220/669; 220/675

(58) Field of Classification Search ..... 215/379.381–383.365; 220/669, 675
See application file for complete search history.

(56) References Cited

U.S. PATENT DOCUMENTS

| | | | | |
|---|---|---|---|---|
| 3,325,031 | A * | 6/1967 | Singier | 215/247 |
| D240,898 | S | 8/1976 | Reynolds | |
| D243,583 | S | 3/1977 | Reynolds | |
| D295,376 | S | 4/1988 | Rogler | |
| 4,749,092 | A * | 6/1988 | Sugiura et al. | 215/381 |
| 4,818,575 | A * | 4/1989 | Hirata et al. | 428/36.7 |
| D308,482 | S | 6/1990 | Wild | |
| D315,869 | S | 4/1991 | Collette | |
| D316,967 | S | 5/1991 | York | |
| D321,830 | S | 11/1991 | York et al. | |
| 5,092,474 | A * | 3/1992 | Leigner | 215/381 |
| 5,178,289 | A * | 1/1993 | Krishnakumar et al. | 215/382 |
| 5,255,889 | A | 10/1993 | Collette et al. | |
| D345,693 | S | 4/1994 | Edstrom | |

(Continued)

FOREIGN PATENT DOCUMENTS

GB 2025889 A * 1/1980

(Continued)

OTHER PUBLICATIONS

U.S. Appl. No. 29/208,008, Filed Jun. 22, 2004 with Dwgs Figs. 1-21 Applicant Eric B. Ungradey.

*Primary Examiner*—Sue A. Weaver
(74) *Attorney, Agent, or Firm*—Knoble Yoshida & Dunleavy, LLC

(57) ABSTRACT

A hot-fill container of one-piece plastic construction includes a base, a neck finish and a cylindrical body connecting the base to the neck finish. The cylindrical body has an upper portion adjacent to the neck finish and a lower portion adjacent to the base. The upper portion of the cylindrical body includes a label panel for securing a label to the container. The lower portion of the container body includes a series of circumferentially spaced ribs, and a series of vacuum panels connected between the ribs. Each of the vacuum panels has an outwardly convex central portion and an outwardly concave intermediate portion that connects the central portion to the ribs. In differing embodiments of the invention, the ribs are either parallel to or at an angle to the central axis of the container. Indicia, such as a logo, may be molded into the central portion of each vacuum panel, which strengthens the central portion of each vacuum panel and resists inversion of each central portion to a concave configuration under hot-fill vacuum within the container.

24 Claims, 3 Drawing Sheets

U.S. PATENT DOCUMENTS 5,303,833 A * 4/1994 Hayashi et al. ..... 215/381
D352,245 S 11/1994 Krishnakumar et al.
D366,416 S 1/1996 Semersky
D366,417 S 1/1996 Semersky
D366,831 S 2/1996 Semersky et al.
D393,802 S 4/1998 Collette et al.
5,735,420 A * 4/1998 Nakamaki et al. ..... 215/373
5,762,221 A * 6/1998 Tobias et al. ..... 215/381
D397,614 S 9/1998 Krishmakumar et al.
5,971,184 A 10/1999 Krishnakumar et al.
D416,198 S 11/1999 Lindsay et al.
D419,882 S 2/2000 Bretz et al.
D420,592 S 2/2000 Bretz et al.
D421,720 S 3/2000 Eberle et al.
6,044,996 A 4/2000 Carew et al.
D426,460 S 6/2000 Krishnakumar et al.
D429,647 S 8/2000 Warner et al.
D434,330 S 11/2000 Rowe et al.
D438,455 S 3/2001 Bretz et al.
D440,158 S 4/2001 Bretz et al.
D441,641 S 5/2001 Piccioli et al.
D442,474 S 5/2001 Piccioli et al.
D445,033 S 7/2001 Bretz et al.
D445,334 S 7/2001 Bretz et al.
6,257,433 B1 * 7/2001 Ogg et al. ..... 215/381
D446,112 S 8/2001 Bretz et al.
D446,126 S 8/2001 Bretz et al.
6,273,282 B1 * 8/2001 Ogg et al. ..... 215/381
D448,673 S 10/2001 Bretz et al.
D454,500 S 3/2002 Bretz et al.
D454,790 S 3/2002 Crawford
D455,078 S 4/2002 Bretz et al.
D457,060 S 5/2002 Bretz et al.
D461,412 S 8/2002 Bretz et al.
D465,158 S 11/2002 Peek et al.
D466,021 S 11/2002 Thierjung et al.
D466,414 S 12/2002 Venkataraman et al.
D469,695 S 2/2003 Bryant et al.
D470,773 S * 2/2003 Darr et al. ..... D9/538
D472,470 S 4/2003 Bretz et al.
6,554,146 B1 4/2003 DeGroff et al.
6,575,321 B2 * 6/2003 Bourque et al. ..... 215/384
6,585,125 B1 * 7/2003 Peek ..... 215/381
D479,690 S 9/2003 DeGroff
D480,957 S 10/2003 Mooney et al.
D482,287 S 11/2003 Kraft
6,827,228 B2 * 12/2004 Headen et al. ..... 215/383
D502,877 S * 3/2005 Stockwell et al. ..... D9/667
6,929,138 B2 * 8/2005 Melrose et al. ..... 215/381
2001/0037992 A1 * 11/2001 Tanabe et al. ..... 215/384
2003/0015491 A1 * 1/2003 Melrose et al. ..... 215/381
2003/0168425 A1 * 9/2003 Yourist ..... 215/381
2004/0159627 A1 * 8/2004 Trude ..... 215/381
2004/0200799 A1 * 10/2004 Yourist et al. ..... 215/381
2005/0035083 A1 * 2/2005 Pedmo et al. ..... 215/381
2005/0121408 A1 * 6/2005 Deemer et al. ..... 215/381

FOREIGN PATENT DOCUMENTS

GB 2025489 9/1992
GB 2064293 3/1997
GB 2080863 2/1999
GB 2090667 2/2000
GB 2091076 3/2000
GB 3008527 11/2002
JP 2000-62743 2/2000
WO WO98/16435 A 4/1998

* cited by examiner

HOT-FILL PLASTIC CONTAINER AND METHOD OF MANUFACTURE

The present invention is directed to a plastic container and method of manufacture that are particularly well adapted for hot-fill applications, and to a hot-filled package that includes such a container.

BACKGROUND AND SUMMARY OF THE INVENTION

In so-called hot-fill packages, a container is filled with hot fluid product and capped while the fluid product is still hot. As the fluid product cools, a reduction in fluid volume creates a vacuum within the package—i.e., an internal pressure within the package that is less than the surrounding atmospheric pressure. Vacuum panels typically are provided in the container sidewall to flex inwardly and thereby to relieve the vacuum pressure within the container. A general object of the present invention is to provide a molded plastic container that is particularly well adapted for such hot-fill applications.

The present invention embodies a number of aspects, which can be implemented separately from or more preferably in combination with each other.

A plastic container in accordance with one aspect of the present invention has at least one vacuum panel for absorbing sub-atmospheric pressure within the container. The vacuum panel has a periphery, an outwardly convex central portion and an outwardly concave intermediate portion that connects the central portion to the periphery. The central and intermediate portions are such as to resist inversion of the central portion of the panel, from an outwardly convex configuration to an outwardly concave configuration, at least to an internal vacuum level of 6 psi within the container (i.e., 6 psi below atmospheric pressure). The central portion of the vacuum panel preferably is oval, and may be provided with molded-in indicia that strengthen the central panel portion and further resist inversion under vacuum. The outwardly convex central portion preferably has a radius of curvature as viewed from an axial direction in the range of 0.6 to 0.75 inch, and a radius of curvature as viewed from a tangential direction in the range of 3 to 5 inches. The outwardly concave intermediate portion of the vacuum panel preferably has a radius of curvature as viewed from an axial direction in the range of 0.175 to 0.25 inch, and a radius of curvature as viewed from a tangential direction in the rang of 0.6 to 0.75 inch. These radii of curvature are such that the central portion of the panel does not invert under vacuum within the container.

A hot-fill container of one-piece plastic construction in accordance with another aspect of the present invention includes a base, a neck finish and a cylindrical body connecting the base to the neck finish. The cylindrical body has an upper portion adjacent to the neck finish and a lower portion adjacent to the base. The upper portion of the cylindrical body includes a label panel for securing a label to the container. The lower portion of the container body includes a series of circumferentially spaced ribs, and a series of vacuum panels connected between the ribs. Each of the vacuum panels has an outwardly convex central portion and an outwardly concave intermediate portion that connects the central portion to the ribs. In differing embodiments of the invention, the ribs are either parallel to or at an angle to the central axis of the container. Indicia, such as a logo, may be molded into the central portion of each vacuum panel, which strengthens the central portion of each vacuum panel and resists inversion of each central portion to a concave configuration under hot-fill vacuum within the container.

BRIEF DESCRIPTION OF THE DRAWINGS

The invention, together with additional objects, features, advantages and aspects thereof, will best be understood from the following description, the appended claims and the accompanying drawings, in which:

DETAILED DESCRIPTION OF PREFERRED EMBODIMENTS

Figure 1:
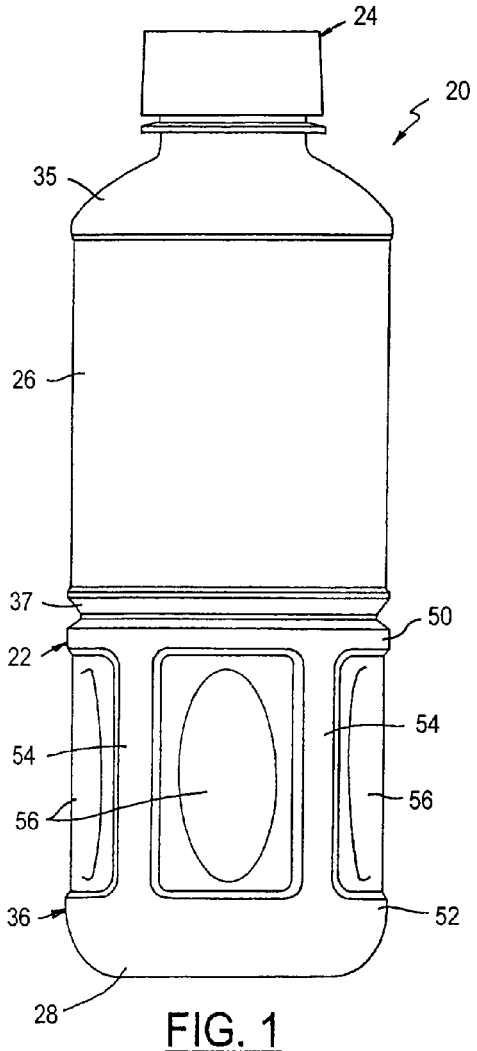
FIG. 1 is a front elevational view of a hot-filled package in accordance with one presently preferred embodiment of the invention.

FIG. 1 illustrates a hot-filled package 20 in accordance with one aspect of the present invention as including a container 22 filled with product while the product is hot and capped by a closure 24. A label 26 is wrapped around the upper portion of the container body.

Figure 2:
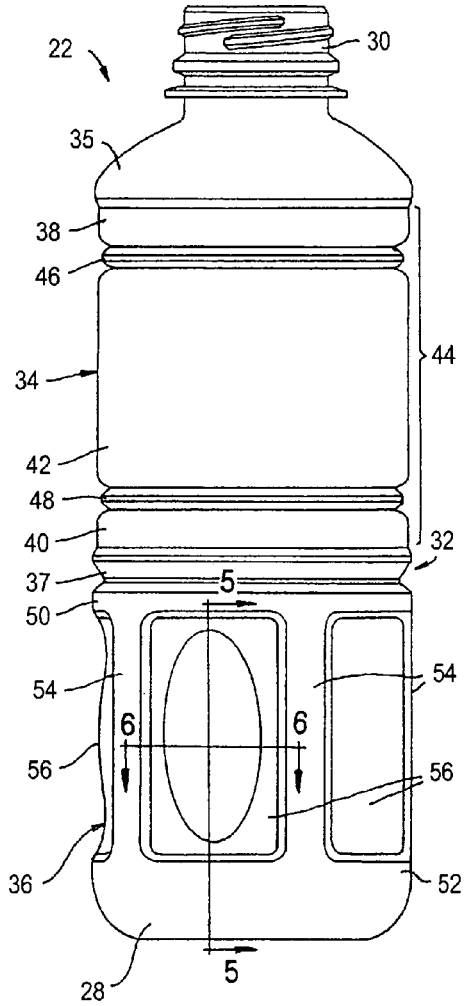
FIG. 2 is a side elevational view of the container in the package of FIG. 1.
Figure 3:
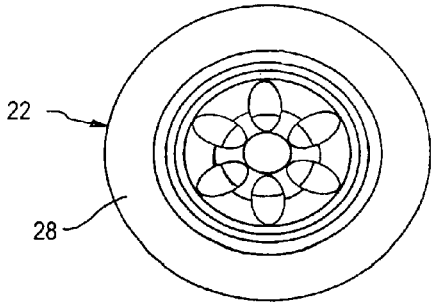
FIG. 3 is a bottom view of the container in FIGS. 1 and 2.
Figure 4:
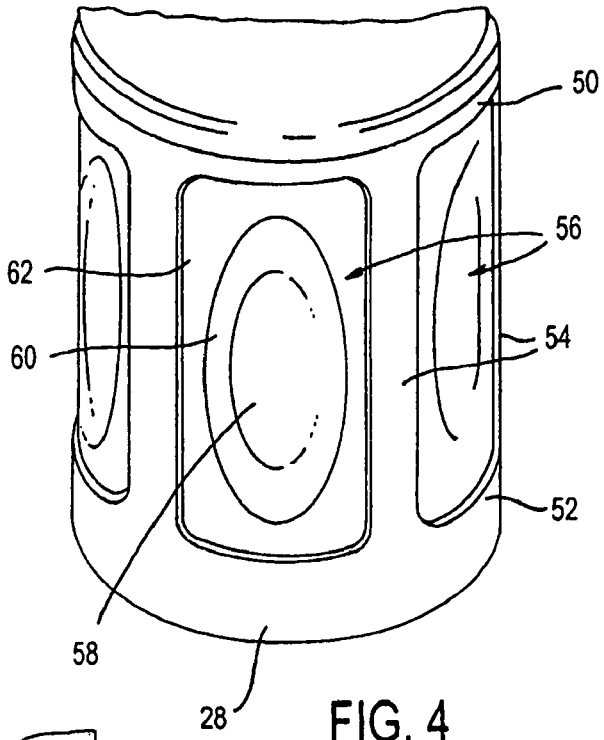
FIG. 4 is a fragmentary perspective view of the lower portion of the container body in FIGS. 1-2 showing the contours of the vacuum panels in accordance with one aspect of the present invention.

Referring to FIGS. 2-4, container 22 includes a base 28, a neck finish 30 for securement of closure 24 (FIG. 1) and a generally cylindrical body 32 extending between and connecting base 28 with neck finish 30. Body 32 includes an upper portion 34 connected to neck finish 30 by a shoulder 35, and a lower portion 36 connected to base 28. Upper body portion 34 preferably is connected to lower body portion 36 by a circumferential channel 37. A pair of axially spaced circumferential bands 38, 40 and a center portion 42 have outer surfaces on a common cylinder of revolution and form a label panel 44 on upper container portion 34. Center portion 42 is connected to bands 38, 40 by M-shaped ribs 46, 48. (Directional words such as "upper" and "lower" are employed by way of description and not limitation with respect to the upright orientation of the container illustrated in FIGS. 1 and 2. Directional words such as "axial" and "tangential" are employed by way of description and not limitation with respect to the central axis of container body 34, which preferably is also the central axis of neck finish 30, base 28 and container 22 as a whole.) FIG. 2 illustrates an exemplary but presently preferred configuration of neck finish 30. Other neck finish configurations can be employed. Likewise, the illustrated geometries of shoulder 35 and base 28 are merely exemplary, albeit presently preferred. Container 22 can be fabricated using any suitable manufacturing technique, preferably by reheat blow molding a container preform. The plastic composition of container 22 can be of monolayer or multilayer construction, with one presently preferred construction being of multilayer polyethylene terephthalate (PET) and barrier material such as nylon or ethylene vinyl alcohol (EVOH).

Figure 7:
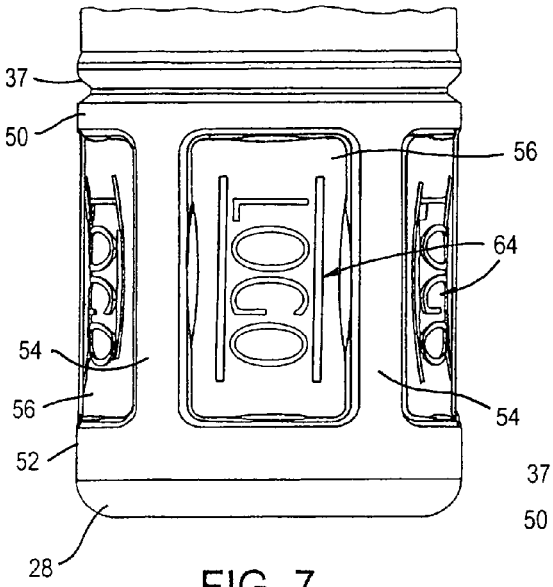
FIGS. 7, 8 and 9 are fragmentary front elevational views of containers in accordance with respective alternative embodiments of the invention.
Figure 8:
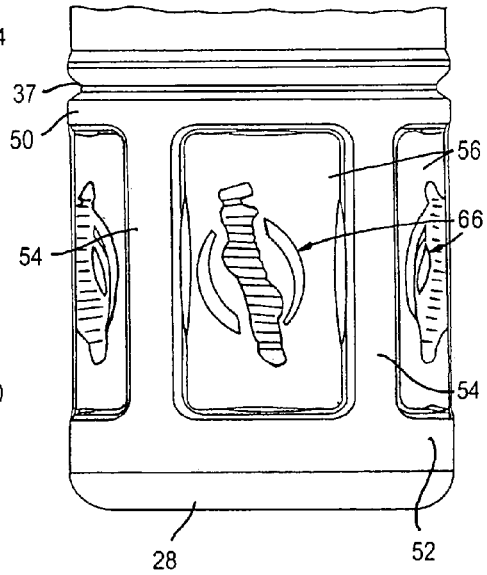

Lower container body portion 36 includes an upper band 50, a lower band 52 spaced axially from upper band 50, and a circumferential series of angularly spaced ribs 54 that extend between upper band 50 and lower band 52. Ribs 54 extend in a direction parallel to the axis of the container in the embodiments of FIGS. 1-8. Between bands 50, 52 and each sequential pair of ribs 54 is an integrally molded vacuum panel 56. Vacuum panels 56 preferably are identical, have parallel sides and parallel ends, and are of rectangular configuration in the embodiment of FIGS. 1-6. Each vacuum panel 56 has a peripheral portion 62 connected to ribs 54 and bands 50, 52, a central portion 58 that is outwardly convex, and an intermediate portion 60 that is outwardly concave and connects central portion 58 to peripheral portion 62 of the vacuum panel. Outwardly convex central portion 58 preferably is of oval configuration as viewed in side elevation, as best seen in FIG. 4. One distinguishing feature of the present invention is that outwardly convex central portion 58 does not invert and become outwardly concave under vacuum pressure within the container within the normal hot fill vacuum pressure range of 4 to 8 psi. This feature is accomplished by specially contouring the radii of curvature of central and intermediate portions 58,60, and in some embodiments by the addition of molded-in indicia to central portion 58 (FIGS. 7 and 8).

Figure 5:
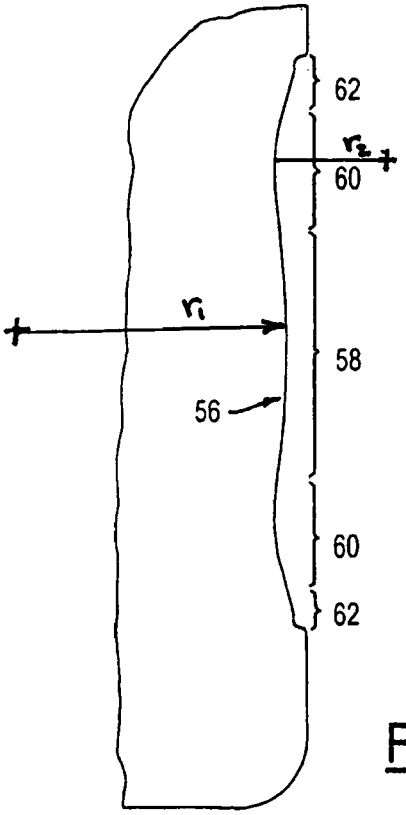
FIG. 5 is a fragmentary schematic diagram of a vacuum panel outer surface taken substantially along the line 5-5 in FIG. 2.
Figure 6:
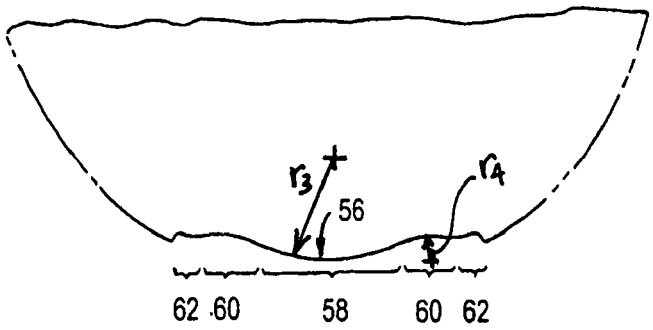
FIG. 6 is a fragmentary schematic diagram of a vacuum panel outer surface taken substantially along the line 6-6 in FIG. 2.

FIG. 5 illustrates the radii of curvature of the outer surfaces of vacuum panels 56 as viewed from a direction tangential to the container axis, and FIG. 6 illustrates the radii of curvature of the outer surfaces of the vacuum panels 56 as viewed from a direction axially of the container. (Inasmuch as the containers are blow molded, vacuum panels 56 are of uniform wall thickness.) As viewed from the tangential direction (FIG. 5), central vacuum panel portion 58 has a radius of curvature $r_1$ in the range of 3-5 inches, and intermediate portion 60 has a radius of curvature $r^2$ in the range of 0.6 to 0.75 inch. As viewed from the axial direction (FIG. 6), central portion 58 has a radius of curvature $r_3$ in the range of 0.6 to 0.75 inch, and intermediate portion 60 has a radium of curvature $r_4$ in the range of 0.175 to 0.25 inch. In one presently preferred sixteen-ounce container illustrated in the drawings, each vacuum panel 56 has an axial dimension of about 2.150 inch (all exemplary linear and angular dimensions are nominal) and an angular dimension of about 75.5° Central portion 58 has an axial dimension of about 1.1 inch and a radium of curvature of about 4 inches as viewed from the tangential direction. Intermediate portion 60 has an axial dimension of about 0.25 inch and a radius of curvature of about 0.675 inch from the tangential direction. As viewed from the axial direction, central portion 58 has a chordal dimension of about 0.56 inch and a radius of curvature of about 0.675 inch. Intermediate portion 60 has a chordal dimension of about 0.2 inch, and a blended radius of curvature of about 0.215 inch adjacent to central portion 58 and 1.0 inch adjacent to peripheral portion 62. It has been found that, after hot-filling the container with liquid at a temperature of 185° F., capping the container and then allowing the package to cool to room temperature, the package has an internal vacuum pressure of 6 psi and central portions 58 of vacuum panels 56 retain their outwardly convex configuration. (The vacuum panels so tested have a wall thickness in the range of 0.012 to 0.016 inch and the configuration with logo illustrated in FIG. 8.)

Inclusion of molded-in indicia in vacuum panel central portions 58 enhances the strength of these vacuum panels central portions and further resists inversion under vacuum within the container. These molded-in indicia have the same wall thicknesses as the vacuum panel central potions and function as strengthening ribs within the vacuum panel central portions. FIG. 7 illustrates a vacuum panel 56 having molded-in indicia 64 in the form of a "LOGO." FIG. 8 illustrates a vacuum panel 56 having molded in indicia 66 in the form of a "Veryfine" logo (a trademark of Veryfine products).

Figure 9:
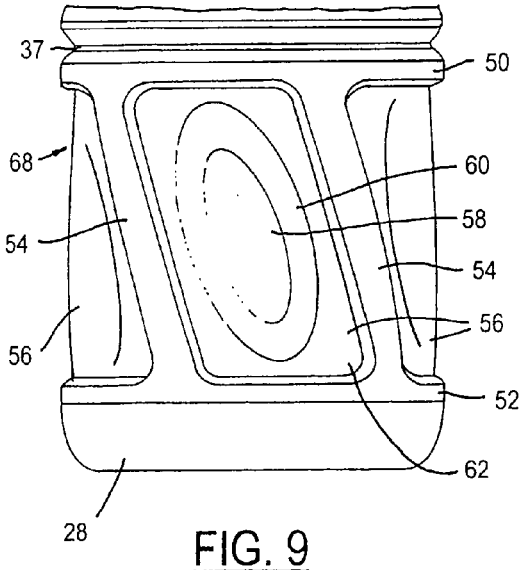

FIG. 9 illustrates a container 68 having vacuum panels 56 in the form of parallelograms rather than rectangles, being disposed between ribs 54 that are at an angle to the axis of the container. The central portions 58 of the vacuum panels in FIG. 9 can be provided with molded-in indicia.

There thus have been disclosed a hot-fill plastic container, package and method of manufacture that fully satisfy all of the objects and aims previously set forth. The invention has been disclosed in conjunction with several presently preferred embodiments thereof, and a number of modifications and variations have been described. Other modifications and variations readily will suggest themselves to persons of ordinary skill in the art in view of the foregoing disclosure. The invention is intended to embrace all such modifications and variations as fall within the spirit and broad scope of the appended claims.

The invention claimed is:

1. A plastic container having at least one vacuum panel for absorbing sub-atmospheric pressure within the container, said vacuum panel having a periphery, a central portion that is outwardly convex in both an axial and a tangential direction, smoothly transitioning to an outwardly concave intermediate portion connecting said central portion to said periphery, said central and intermediate portions being such as to resist inversion of said central portion under vacuum within the container to at least a vacuum level of 6 psi within said container.

2. The container set forth in claim 1 including indicia molded into said central portion of said vacuum panel further to resist inversion of said central portion under vacuum.

3. The container of claim 1, wherein the central portion is oval shaped.

4. A plastic container having at least one vacuum panel for absorbing sub-atmospheric pressure within the container, said vacuum panel having a periphery, an outwardly convex central portion and an outwardly concave intermediate portion connecting said central portion to said periphery, said outwardly convex central portion having a radius of curvature as viewed from an axial direction in the range of 0.6 to 0.75 inch and a radius of curvature as viewed from a tangential direction in the range of 3 to 5 inches, said outwardly concave intermediate portion having a radius of curvature as viewed from an axial direction in the range of 0.175 to 0.25 inch and a radius of curvature as viewed from a tangential direction in the range of 0.6 to 0.75 inch.

5. The container set forth in claim 4 wherein said outwardly convex central potion has a radius of curvature as viewed from an axial direction of about 0.675 inch and a radius of curvature as viewed from a tangential direction of about 4 inches.

6. The container set forth in claim 5 wherein said outwardly concave intermediate portion has a radius of curvature as viewed from an axial direction of about 0.215 inch and a radius of curvature as viewed from a tangential direction of about 0.675 inch.

7. The container set forth in claim 4 wherein said vacuum panel has a thickness in the range of 0.12 to 0.16 inch.

8. The container set forth in claim 4 wherein said vacuum panel has sides parallel to an axis of the container.

9. The container set forth in claim 4 wherein said vacuum panel has sides at an angle to an axis of the container.

10. The container set forth in claim 4 including indicia molded into said central portion of said vacuum panel.

11. A hot-fill container of one-piece plastic construction that includes:

a base, a neck finish and a cylindrical body connecting said base to said neck finish, said cylindrical body having an upper portion adjacent to said neck finish and a lower portion adjacent to said base, said upper portion including a label panel for securing a label to said container, said lower portion including a series of circumferentially spaced ribs and a series of vacuum panels connected between said ribs, each of said vacuum panels having a central portion that is outwardly convex in both an axial and a tangential direction, smoothly transitional to an outwardly concave intermediate portion connecting said central portion to said ribs.

12. The container set forth in claim 11 including indicia molded into said central portions of said vacuum panels.

13. The container set forth in claim 11 wherein said ribs are parallel to an axis of said container.

14. The container set forth in claim 11 wherein said ribs are at an angle to a central axis of said container.

15. The container set forth in claim 11 wherein said upper portion of said body includes upper and lower bands, a central portion having an outer surface cocylindrical with said bands, and ribs separating said central portion from said upper and lower bands.

16. The container set forth in claim 11 wherein said outwardly convex central portion having a radius of curvature as viewed from an axial direction in the range of 0.6 to 0.75 inch and a radius of curvature as viewed from a tangential direction in the range of 3 to 5 inches, and said outwardly concave intermediate portion having a radius of curvature as viewed from an axial direction in the range of 0.175 to 0.25 inch and a radius of curvature as viewed from a tangential direction in the range of 0.6 to 0.75 inch.

17. The container set forth in claim 16 wherein said outwardly convex central portion has a radius of curvature as viewed from an axial direction of about 0.675 inch and a radius of curvature as viewed from a tangential direction of about 4 inches.

18. The container set forth in claim 17 wherein said outwardly concave intermediate portion has a radius of curvature as viewed from an axial direction of about 0.215 inch and a radius of curvature as viewed from a tangential direction of about 0.675 inch.

19. The container set forth in claim 16 wherein said vacuum panel has a thickness in the range of 0.12 to 0.16 inch.

20. The container of claim 11, wherein the central portion is oval shaped.

21. A hot-filled package that includes a plastic container filled with product at elevated temperature, sealed by a closure and cooled to room temperature, said container having at least one vacuum panel absorbing sub-atmospheric vacuum pressure within said container of not less than 6 psi, said vacuum panel having a periphery, a central portion that is outwardly convex in both an axial and a tangential direction, smoothly transitioning to an outwardly concave intermediate portion connecting said central portion to said periphery.

22. The package set forth in claim 18 including indicia molded into said central portions of said vacuum panels.

23. The package set forth in claim 22 wherein said vacuum panel has a thickness in the range of 0.12 to 0.16 inch.

24. The container of claim 21, wherein the central portion is oval shaped.

* * * * *